US007107813B2

(12) United States Patent
Koura et al.

(10) Patent No.: US 7,107,813 B2
(45) Date of Patent: Sep. 19, 2006

(54) PROGRESSIVE PRESSING APPARATUS

(75) Inventors: Norio Koura, Anjo (JP); Yuichi Koishi, Okazaki (JP)

(73) Assignee: Aisin AW Co., Ltd., Aichi-ken (JP)

( * ) Notice: Subject to any disclaimer, the term of this patent is extended or adjusted under 35 U.S.C. 154(b) by 77 days.

(21) Appl. No.: 10/937,506

(22) Filed: Sep. 10, 2004

(65) Prior Publication Data

US 2005/0050938 A1 Mar. 10, 2005

(30) Foreign Application Priority Data

Sep. 10, 2003 (JP) ..... 2003-318114

(51) Int. Cl.
*B21J 13/04* (2006.01)

(52) U.S. Cl. ..... 72/404; 72/446; 72/448; 72/455

(58) Field of Classification Search ..... 72/446–448, 72/404, 470, 473, 455, 454; 100/207
See application file for complete search history.

(56) References Cited

U.S. PATENT DOCUMENTS 3,881,343 A * 5/1975 Ducate ..... 72/455
4,090,391 A * 5/1978 Hish ..... 72/422
4,779,329 A * 10/1988 Nordquist et al. ..... 483/29
5,022,129 A * 6/1991 Gentry ..... 29/6.01
5,054,353 A * 10/1991 Haack et al. ..... 83/639.5
5,473,926 A 12/1995 Futamura et al.
5,673,585 A * 10/1997 Bishop ..... 72/447

FOREIGN PATENT DOCUMENTS

JP 5-329699 12/1993
JP 08-214510 8/1996

* cited by examiner

*Primary Examiner*—Daniel C. Crane
(74) *Attorney, Agent, or Firm*—Sughrue Mion, PLLC

(57) ABSTRACT

A progressive pressing apparatus having multiple pressing stages, each including a gate-shaped supporting frame on which one of a plurality of die sets is detachably and adjustably disposed. The apparatus further includes rails above the pressing stages. Each supporting frame is movable along the rails, and includes a hydraulic cylinder which applies a pressing force to the corresponding die set while extending in the vertical direction. Two opposite upper end portions of each supporting frame are provided with rolling wheels which are capable of rolling along the upper surfaces of the rails. Each supporting frame includes a pair of columns. Each pair of columns is respectively provided with a pair of securing units. Each pair of securing units secures the corresponding supporting frame to a base in a state such that the rolling wheels of the corresponding supporting frame are not in contact with the rails.

7 Claims, 7 Drawing Sheets

S1, S2, S3, S4

FIG. 4
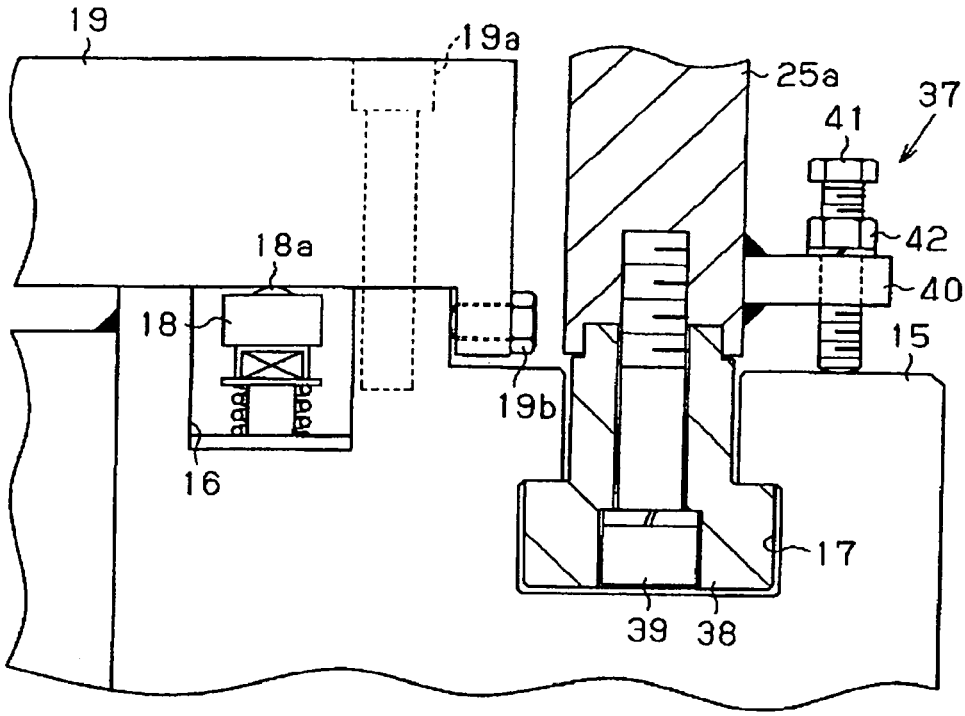
FIG. 5
FIG. 5A
FIG. 5B
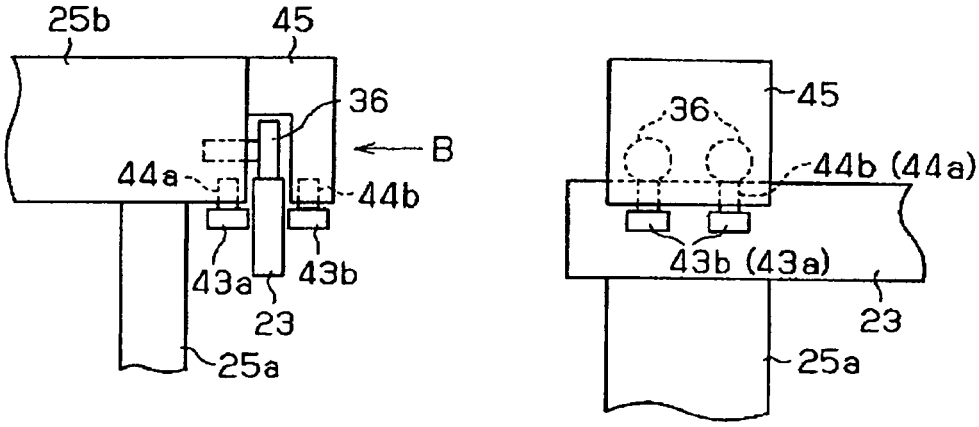

FIG. 6
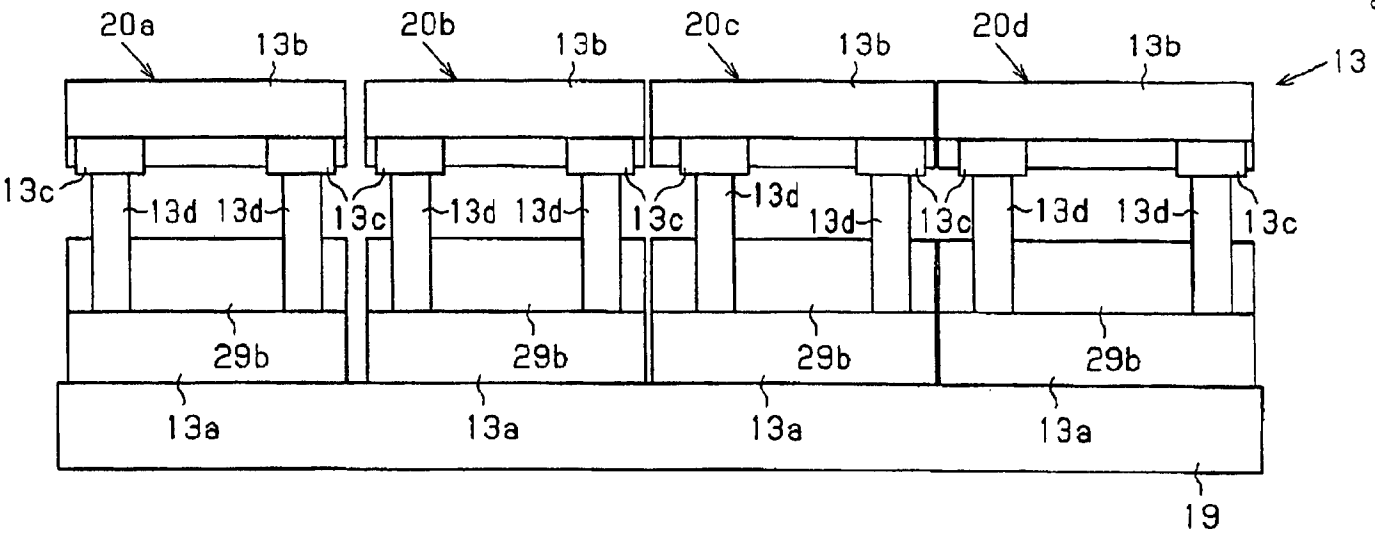
FIG. 6A
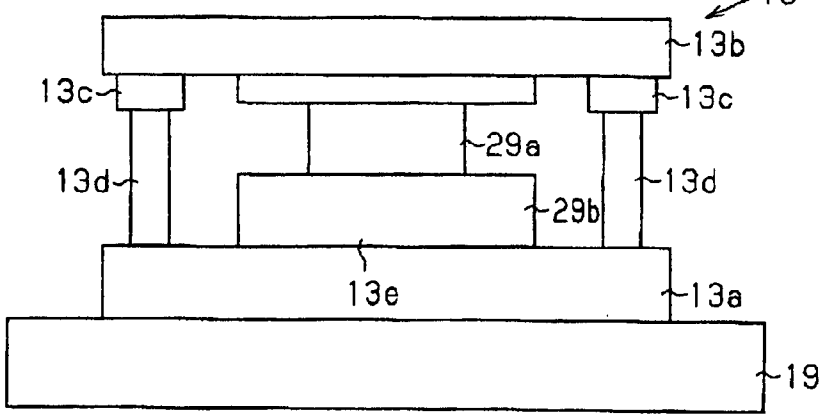
FIG. 6B

PROGRESSIVE PRESSING APPARATUS

INCORPORATION BY REFERENCE

The disclosure of Japanese Patent Application No. 2003-318114 filed on Sep. 10, 2003, including the specification, drawings and abstract thereof, is incorporated herein by reference in its entirety.

BACKGROUND OF THE INVENTION

1. Field of the Invention

The present invention relates to progressive pressing apparatuses, and particularly, to a progressive pressing apparatus provided with multiple die pressing units for performing pressing on a belt-like plate material or sheet material at multiple stages.

2. Description of the Related Art

Japanese Unexamined Patent Application Publication No. 8-214510 (see paragraphs [0017] to [0019] of the specification, and FIG. 1) discloses a typical progressive die pressing apparatus for manufacturing rotors and stators used in motors. According to such an apparatus, segments of a belt-like steel plate are pressed and punched out to fabricate parts of a rotor, and other segments of the plate are subsequently pressed and punched out so as to fabricate parts of a stator. For performing the pressing operation on a steel plate using such a conventional apparatus, the center of each die that performs the pressing must be set at a predetermined position corresponding to one of the pressing stages provided in the apparatus. Generally, in such a conventional apparatus, each stage is provided with a pressing unit fixed to a predetermined position.

Furthermore, Japanese Unexamined Patent Application Publication No. 5-329699 (see paragraphs [0005] and [0006] of the specification, and FIG. 1) discloses a type of a progressive fabrication apparatus. In this conventional apparatus, multiple pressing units are provided. A cassette is detachably provided on each pressing unit and includes a plurality of pressing means. The apparatus is further provided with a base having dovetail grooves. Each pressing unit is adjustably disposed in the dovetail grooves such that the pressing unit is movable along the dovetail grooves. Each cassette includes a set of a punch and a die. Moreover, a hydraulic cylinder is disposed above each cassette and is provided with an activating rod connected to the corresponding punch.

In the progressive die pressing apparatus disclosed in Japanese Unexamined Patent Application Publication No. 8-214510, the position of each pressing unit of the corresponding stage cannot be readjusted. For this reason, the only way to cope with manufacturing rotors and stators having different diameters is to replace the die assembly with another type. Consequently, for manufacturing rotors and stators that have small diameters, this may be problematic in that the amount of unused areas (unpunched areas) of the steel plate becomes large. To reduce the amount of the unused areas, it is necessary to provide a progressive die pressing apparatus having pressing units that are positioned at a pitch corresponding to the diameter of the stators to be manufactured.

On the other hand, in the progressive fabrication apparatus disclosed in Japanese Unexamined Patent Application Publication No. 5-329699, since the multiple pressing units are adjustably disposed in the dovetail grooves such that each pressing unit is movable along the dovetail grooves, each pressing unit can be shifted to a position suitable with respect to the diameter sizes of the rotor and the stator to be manufactured. Thus, the problem of the large amount of unused areas of the steel plate can be solved. However, the shifting of each pressing unit requires a large amount of force since each pressing unit moves along the dovetail grooves in the base. As an alternative to this structure, the base may be provided with rails in place of the dovetail grooves, and each pressing unit may be provided with, for example, wheels at the bottom portions of the pressing unit so that the pressing unit can be rolled along the rails. However, such an alternative structure may be problematic in that the pressing units may become unstable during the shifting process since the pressing units carry heavy components, such as the hydraulic cylinders and working-oil supplying devices, that are necessary for the pressing operation.

SUMMARY OF THE INVENTION

Accordingly, it is an object of the present invention to provide a progressive pressing apparatus in which a plurality of pressing-force applying means for applying a pressing force to dies provided in multiple pressing stages can be easily and stably shifted in the feeding direction of a workpiece, and moreover, can each be readily secured at a desired position.

A progressive pressing apparatus according to the present invention comprises a die assembly including a plurality of die sets detachably disposed on corresponding pressing stages such that the positions of the die sets are adjustable; rails disposed above the pressing stages; supporting frames each corresponding to one of the pressing stages, each supporting frame including an actuator for applying a pressing force to the corresponding one of the die sets in the pressing stages, each supporting frame being movable along the rails; and a plurality of securing units, each supporting frame being provided with a pair of the securing units, each pair of the securing units securing the corresponding supporting frame to a desired position.

Furthermore, the progressive pressing apparatus may further comprise a base. Each supporting frame may have a gate-like structure, and the two opposite upper end portions of each supporting frame may be provided with rolling wheels which are capable of rolling along the upper surfaces of the rails. Each pair of the securing units secures the corresponding supporting frame to the base in a state such that the rolling wheels of the corresponding supporting frame are not in contact with the rails.

Furthermore, in the progressive pressing apparatus of the present invention, each supporting frame may comprise a pair of supporting columns. Each pair of the securing units respectively corresponds to the pair of supporting columns of each supporting frame. The base may be provided with dovetail grooves. Moreover, each securing unit may include a stopper which is fixed to a bottom end of the corresponding supporting column and is movable along the corresponding one of the dovetail grooves; and pressing means for pressing against the base. In detail, the pressing means is disposed adjacent to a bottom portion of a corresponding one of the supporting columns, and is movable between a tightened position and an untightened position. When the pressing means is set at the tightened position, the pressing means presses against the base such that the corresponding supporting column is relatively pressed upward, whereby the corresponding supporting column is clamped between the pressing means and the stopper. On the other hand, when the pressing means is set at the untightened position, the pressing force of the pressing means against the base is released.

Furthermore, in the progressive pressing apparatus of the present invention, each pressing means may comprise a bolt which extends vertically through a bracket protruding outward from the corresponding supporting column such that the bolt is screwed into the bracket.

Furthermore, in the progressive pressing apparatus of the present invention, each actuator may comprise a hydraulic cylinder. Moreover, the upper surface of each supporting frame may be provided with a servo-pump for supplying working oil to the corresponding hydraulic cylinder. The maximum width of each servo-pump is greater than the width of the corresponding supporting frame, and the servo-pumps are alternately arranged on the adjacent supporting frames in a zigzag manner such that the servo-pumps do not interfere with one another.

According to the present invention, each pressing-force applying means, i.e. the actuator, the supporting frame, and the servo-pump, for applying a pressing force to the die set of the corresponding one of the pressing stages, can be easily and stably shifted in the feeding direction of a workpiece, and moreover, can be readily secured to a desired position.

BRIEF DESCRIPTION OF THE DRAWINGS

FIG. 4 is a partially enlarged view of FIG. 1;

FIG. 5A is a partial side view illustrating a supported state of, for example, one of rolling wheels;

FIG. 5B is a side view from a direction indicated by an arrow B in FIG. 5A;

FIG. 6A is a front view of a die assembly;

FIG. 6B is a side view of the die assembly;

DESCRIPTION OF EXEMPLARY EMBODIMENTS

Figure 1:
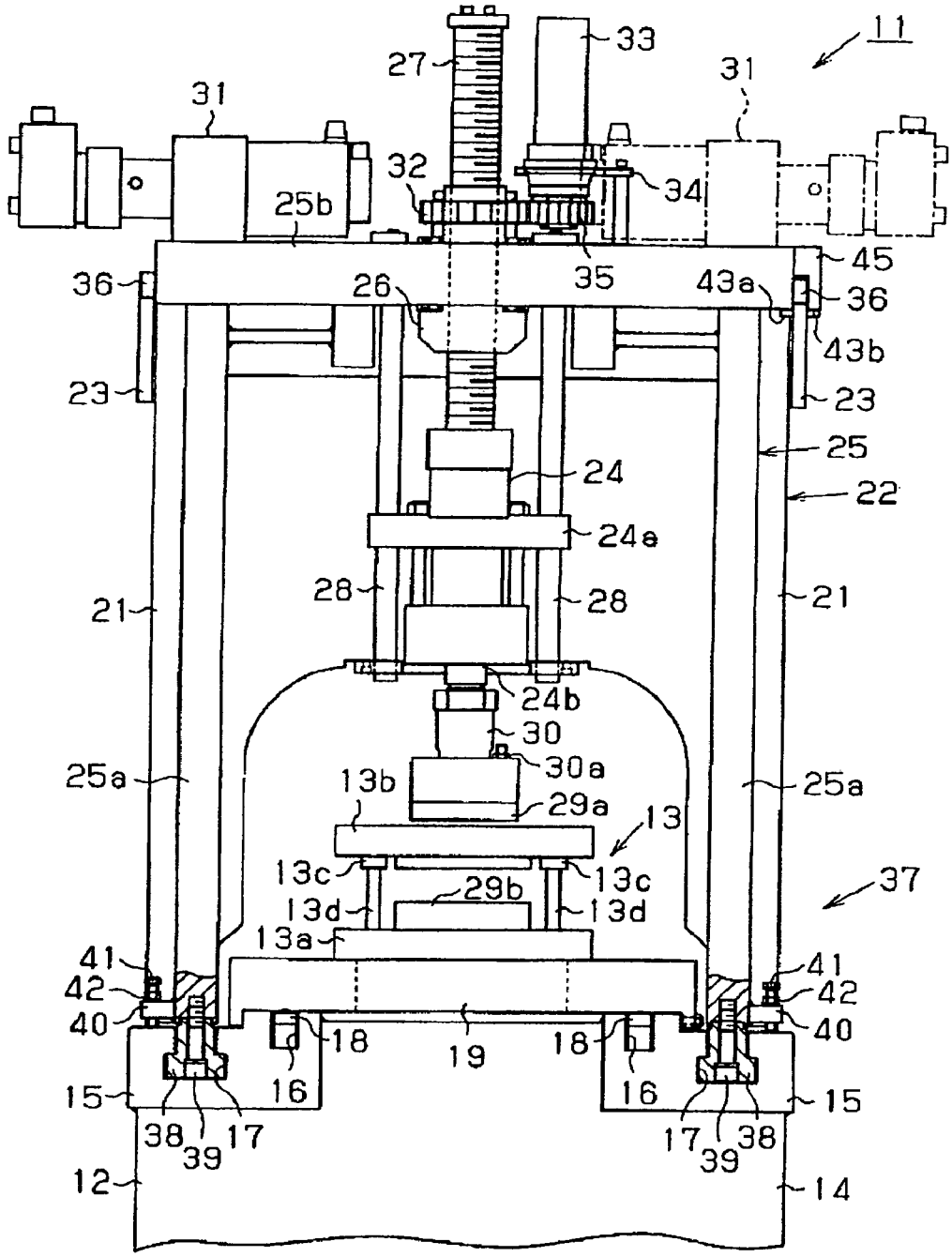
FIG. 1 is a schematic side view of a progressive pressing apparatus according to the present invention.
Figure 2:
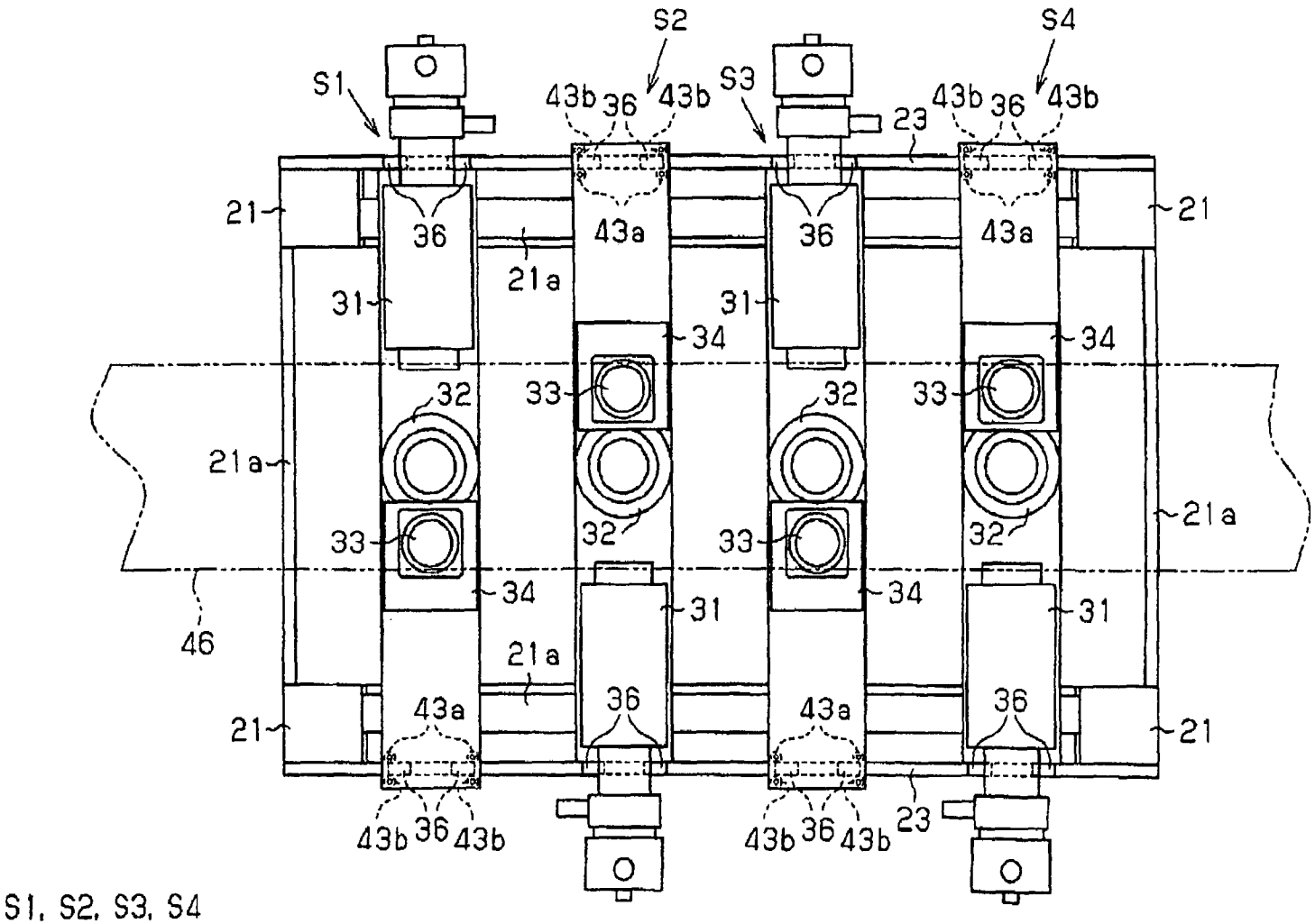
FIG. 2 is a schematic plan view of the progressive pressing apparatus.
Figure 3:
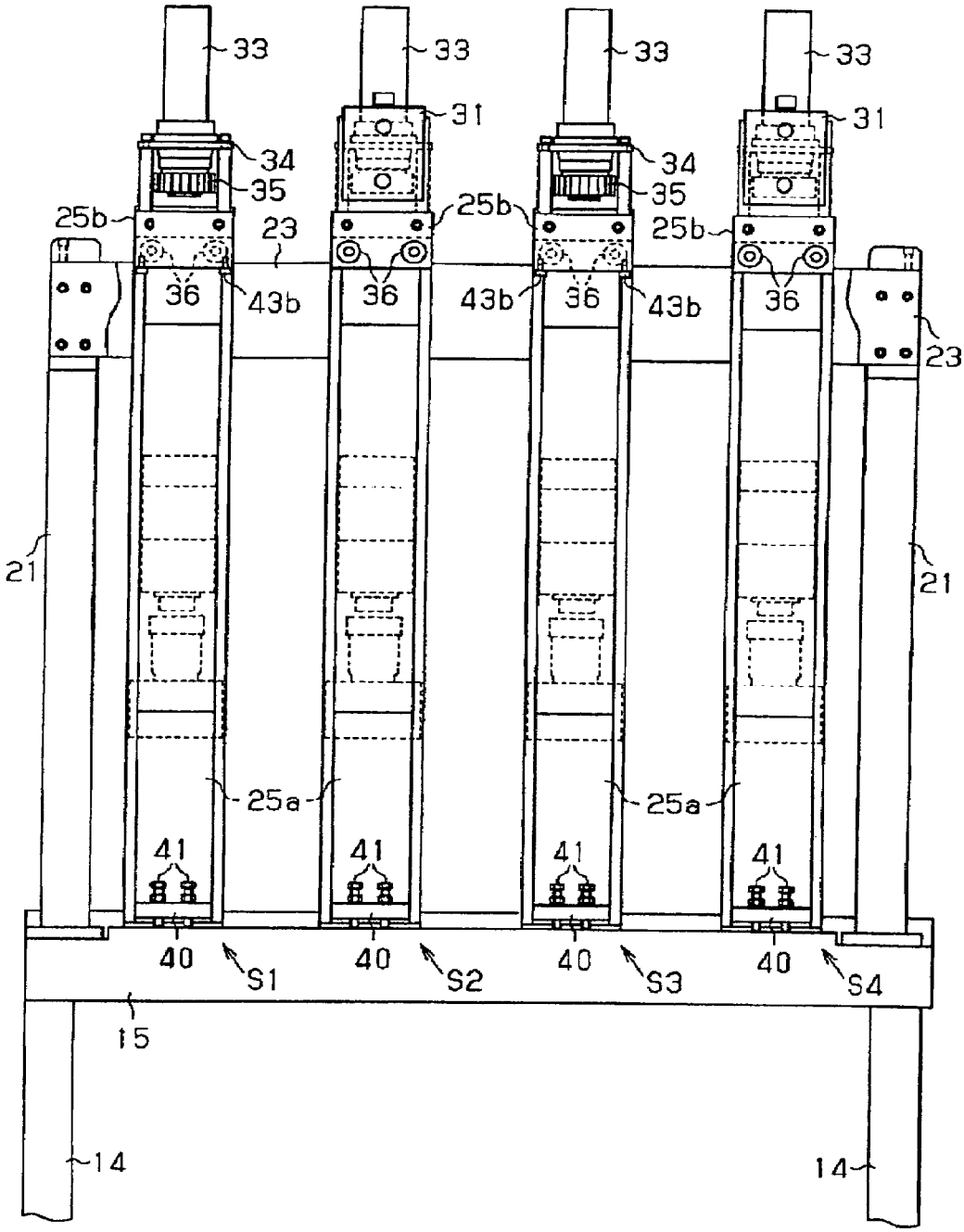
FIG. 3 is a schematic front view of the progressive pressing apparatus.

An embodiment of a progressive pressing apparatus 11 according to the present invention used for manufacturing rotors and stators for motors will now be described with reference to FIGS. 1 to 9. FIG. 1 is a schematic side view of the progressive pressing apparatus 11, FIG. 2 is a schematic plan view of the progressive pressing apparatus 11, and FIG. 3 is a schematic front view of the progressive pressing apparatus 11. FIG. 4 is a partially enlarged view of FIG. 1.

Referring to FIGS. 1 to 3, the progressive pressing apparatus 11 includes a base 12 above which a plurality of pressing stages (four stages S1 to S4 in this embodiment) is disposed. As shown in FIG. 1, a die assembly 13 is detachably and adjustably disposed over the stages S1 to S4.

Referring to FIGS. 1 and 3, the base 12 includes a pair of supporting plates 14 and a pair of base components 15 bridged horizontally across the two supporting plates 14. The die assembly 13 is disposed above the base components 15. Referring to FIGS. 1 to 4, the upper surface of each base component 15 is provided with a groove 16 and a dovetail groove 17 both extending parallel to the feeding direction of a belt-like workpiece. Specifically, the feeding direction refers to a direction extending into and out of the drawings of FIGS. 1 and 4. The grooves 16, which are provided at the inner portions of the apparatus 11, each include free bearings 18 for allowing easier shifting and adjustment of the die assembly 13 above the base components 15. The free bearings 18 disposed in each of the grooves 16 are separated by a predetermined distance. Each of the free bearings 18 rotatably supports a ball 18*a* (shown in FIG. 4) and is biased upward by a spring, such that when the free bearing 18 is in a free state, the ball 18*a* partially protrudes upward from the corresponding groove 16.

Referring to FIGS. 1, 6A, and 6B, the structure of the die assembly 13 will now be described. The die assembly 13 is provided with four die sets 20*a*, 20*b*, 20*c*, and 20*d* corresponding to the pressing stages S1 to S4, respectively. The four die sets 20*a*, 20*b*, 20*c*, and 20*d* are detachably mounted to a common plate 19 with bolts, which are not shown in the drawings, via corresponding die holders 13*a*. Similar to known die assemblies, the die sets 20*a* to 20*d* are each provided with a punch holder 13*b*, a set of guide bushings 13*c*, and a set of guide posts 13*d*. The punch holder 13*b* is capable of moving vertically along the guide posts 13*d* via the guide bushings 13*c*. Referring to FIGS. 4 and 6A, the common plate 19 is fixed to the base components 15 with bolts 19*a* and 19*b* such that the die assembly 13 is fixed above the base components 15. Moreover, in this fixed state, the undersurface of the common plate 19 is in contact with the free bearings 18.

Referring to FIGS. 1 to 3, a pair of supporting columns 21 is disposed on each of the base components 15. As shown in FIGS. 1 and 2, two connecting plates 21*a* are provided such that each connecting plate 21*a* connects the upper portions of the corresponding pair of supporting columns 21 so as to form a supporter 22. Referring to FIG. 1, two opposite upper end portions of the supporter 22 are respectively provided with a pair of rails 23. The rails 23 extend parallel to the feeding direction of a workpiece. Furthermore, four supporting frames 25 are respectively provided for the pressing stages S1 to S4 and each include a hydraulic cylinder 24 functioning as an actuator for applying a pressing force to the die assembly 13. The supporting frames 25 are movable along the rails 23.

Referring to FIGS. 1 and 3, each of the supporting frames 25 further includes a pair of supporting columns 25*a* and a supporting block 25*b* bridged between the upper ends of the two supporting columns 25*a* so as to form a gate-like structure. Moreover, a nut 26 extends through the center of each supporting block 25*b* in a rotatable manner, but said supporting block 25*b* is not permitted to move in the axis direction of the nut 26. A screw shaft 27 extends through the nut 26 such that the screw shaft 27 is screwed into a female screw portion of the nut 26. A head portion of each hydraulic cylinder 24 is fixed to the bottom end of the corresponding screw shaft 27. Furthermore, each supporting block 25*b* is provided with a pair of guide rods 28 which extend in the vertical direction of the drawings. The guide rods 28 extend through a flanged portion 24*a* of the hydraulic cylinder 24. Each hydraulic cylinder 24 is capable of extending in the vertical direction and has a piston rod 24*b* protruding downward from the hydraulic cylinder 24. While maintaining this state, the hydraulic cylinder 24 is supported by the guide rods 28 in a vertically movable manner. A connection head 30, which is connected with a punch 29*a* for one of the die sets 20*a* to 20*d*, is fixed to the end of each piston rod 24*b*.

Figure 7:
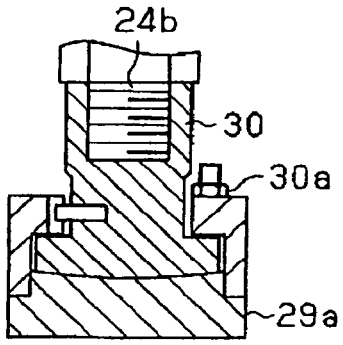
FIG. 7 is a schematic cross-sectional view illustrating a connection state of a connection head and a punch.

Referring to FIG. 7, the connection head 30 and the punch 29*a* are connected to each other with a bolt 30*a*. Referring to FIG. 6B, the punch 29*a* is attached to the punch holder 13*b* in a vertically movable manner and co-operates with a die 29*b* so that pressing can be performed.

Referring to FIG. 1, a servo-pump 31 is provided adjacent to one of the ends of the upper surface of each supporting block 25*b*. Each servo-pump 31 supplies working oil to the corresponding hydraulic cylinder 24 via a pipe, which is not shown in the drawings. Referring to FIG. 2, the maximum width occupied by each servo-pump 31 is greater than the width of the supporting block 25*b* of the corresponding supporting frame 25. To prevent the servo-pumps 31 on the adjacent supporting frames 25 from interfering with one another, the four servo-pumps 31 are alternately arranged in a zigzag manner. Each set of the hydraulic cylinder 24, the supporting frame 25, and the servo-pump 31 defines pressing-force applying means for applying pressing force to one of the die sets 20*a* to 20*d* in the die assembly 13; that is, to the corresponding one of the pressing stages S1 to S4.

A protruding portion of each nut 26 adjacent to the upper side of the corresponding supporting block 25*b* is provided with a gear 32, which is rotatable together with the nut 26. The upper surface of each supporting block 25*b* is provided with a servomotor 33 whose output shaft protrudes downward and is fixed to the supporting block 25*b* via a bracket 34. A gear 35, which is meshed with the gear 32, is fixed to the output shaft of the servomotor 33 and is rotatable together with the output shaft. When the servomotor 33 is driven, the screw shaft 27 moves upward or downward depending on the rotational direction of the servomotor 33. This movement of the screw shaft 27 correspondingly moves the hydraulic cylinder 24 upward or downward. The purpose of this movability of the hydraulic cylinder 24 is to prevent the connection head 30 from interfering with the die sets 20*a* to 20*d* when replacing the entire die assembly 13 or individually replacing the die sets 20*a* to 20*d* of the respective pressing stages S1 to S4.

The structure for moving the supporting frames 25 along the rails 23 and the structure for securing the supporting frames 25 to a desired position will now be described. Referring to FIGS. 1 to 3, the two opposite ends of each supporting block 25*b*, that is, the two upper end portions of each supporting frame 25, are provided with rolling wheels 36 which are capable of rolling along the upper surfaces of the rails 23.

Referring to FIGS. 1 and 4, the two supporting columns 25*a* of each supporting frame 25 are respectively provided with a pair of securing units 37 for securing the supporting frame 25 to the base components 15 in a state where the rolling wheels 36 are lifted upward and are thus not in contact with the rails 23. The bottom end of each supporting column 25*a* is provided with a stopper 38. The stopper 38 is fixed to the bottom end with a bolt 39 and is movable along the dovetail groove 17 of the corresponding base component 15. Moreover, the bottom portion of each supporting column 25*a* is provided with a bracket 40 protruding outward in the horizontal direction. The bracket 40 has a screw hole through which a bolt 41 extends vertically such that the bolt 41 is screwed into the bracket 40. The bolt 41 is also screwed into a nut 42 which is disposed adjacent to the upper surface of the bracket 40.

When the bolt 41 is not pressed against the upper surface of the corresponding base component 15, the stopper 38 does not completely engage with the dovetail groove 17, and moreover, has a size that allows the rolling wheels 36 to be into contact with the upper surface of the corresponding rail 23 so that the rolling wheels 36 are capable of rolling along the rail 23. The bolt 41 can be disposed either at a tightened position or an untightened position. Specifically, when the bolt 41 is in the tightened position, the bolt 41 presses against the upper surface of the corresponding base component 15 so that the supporting column 25*a* is relatively pressed upward. Thus, the bolt 41 and the stopper 38 clamp the base component 15. In contrast, when the bolt 41 is in the untightened position, the pressing force of the bolt 41 against the upper surface of the base component 15 is released. The bolt 41 thus functions as pressing means. Consequently, the stoppers 38 and the bolts 41 are defined as the securing units 37 for securing the supporting frames 25 to a desired position.

Referring to FIGS. 1 to 3, an end of each supporting block 25*b* opposite to the end having the servo-pump 31 is provided with guide rollers 43*a* and 43*b*. The guide rollers 43*a* and 43*b* prevent the corresponding supporting frame 25 from deviating when the supporting frame 25 is being shifted along the rails 23. The guide rollers 43*a* and 43*b* are disposed at positions where they can contact the side surfaces of the corresponding rail 23. Referring to FIGS. 5A and 5B, the guide rollers 43*a* and the guide rollers 43*b* are respectively disposed adjacent to two opposite sides of the rail 23. The guide rollers 43*a* are disposed adjacent to the inner surface of the rail 23 and is supported by a pin 44*a*, which is fixed to the supporting block 25*b*. On the other hand, the guide rollers 43*b* are disposed adjacent to the outer surface of the rail 23 and is supported by a pin 44*b*, which is fixed to a bracket 45. The bracket 45 is fixed to the supporting block 25*b*.

Figure 8A:
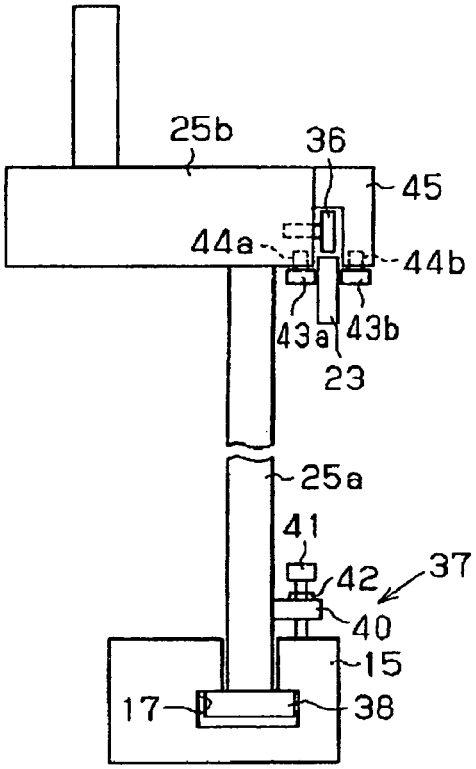
FIG. 8A is a schematic side view of one of supporting columns in a secured state.
Figure 8B:
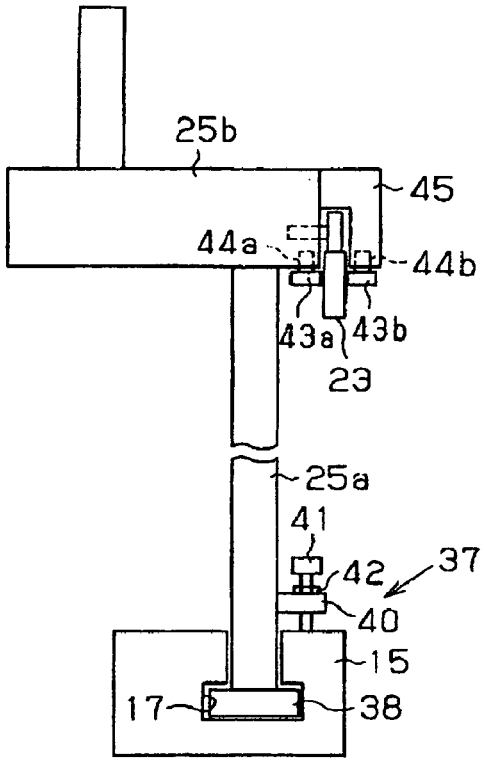
FIG. 8B is a schematic side view of one of the supporting columns in a motional state.

The operation of the progressive pressing apparatus 11 will now be described. Each of the supporting frames 25 is secured to a predetermined position on the base components 15 while corresponding to one of the die sets 20*a* to 20*d* of the respective pressing stages S1 to S4. In this state, as shown in FIGS. 4 and 8A, the tip of each bolt 41 presses against the upper surface of the corresponding base component 15 such that the stopper 38 presses against the undersurface of the dovetail groove 17. The stopper 38 and the bolt 41 thus secure the bottom portion of the corresponding supporting column 25*a* to the base component 15. Moreover, as shown in FIG. 8A, the rolling wheels 36 are lifted upward and are not in contact with the upper surface of the corresponding rail 23. Unlike pressing the supporting frames 25 downward to secure the supporting frames 25 to the base components 15, the securing method of the present invention prevents the rolling wheels 36 from receiving unnecessary force.

Figure 9:
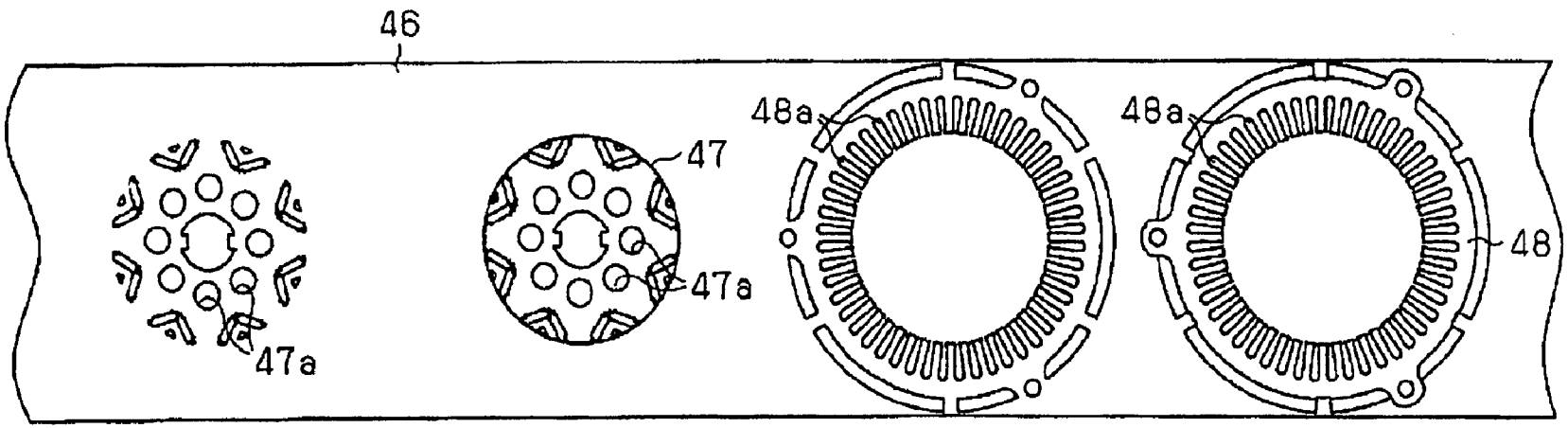
FIG. 9 is a plan view illustrating a manufacturing process of a rotor and a stator.

A workpiece, which was mentioned previously, is a thin belt-like steel plate 46, as shown in FIG. 9, having a thickness of 0.2 to 0.3 mm. Each stroke of the piston rods 24*b* of the hydraulic cylinders 24 needs to be about 2 mm for the pressing operation. In such a case, for a replacement of the die assembly 13, each connection head 30 must be lifted to a position where the connection head 30 does not interfere with the die assembly 13. According to this embodiment, although the piston rod 24*b* provided in each hydraulic cylinder 24 is capable of reciprocating and meets the stroke requirement for the pressing operation, the replacement of the die assembly 13 is performed by lifting all of the hydraulic cylinders 24 to a position where the connection heads 30 do not interfere with the die assembly 13.

Each hydraulic cylinder 24 is lifted upward by driving the corresponding servomotor 33 and rotating the corresponding nut 26 in the normal direction. When the nut 26 rotates in the normal direction, the screw shaft 27 screwed into the nut 26 is relatively moved upward with respect to the rotating nut 26, but does not rotate with the nut 26 since the screw shaft 27 is fixed to the non-rotatable hydraulic cylinder 24. Thus, the hydraulic cylinder 24 is lifted upward together with the screw shaft 27. In contrast, when the nut 26 rotates in the reverse direction, the screw shaft 27 and the hydraulic cylinder 24 are moved downward.

During the pressing operation, each hydraulic cylinder 24 is set at its predetermined pressing position, and the belt-like steel plate 46 is intermittently fed at a predetermined pitch via a feeding device, which is not shown in the drawings, such that each segment of the steel plate 46 to be pressed is set at a predetermined position of one of the corresponding pressing stages S1 to S4. The servo-pump 31 corresponding to one of the pressing stages S1 to S4 subject to pressing is then driven so as to supply working oil to the projected portion of the corresponding piston rod 24*b*. The corresponding punch 29*a* thus moves downward so as to perform pressing on the steel plate 46. Subsequently, the servo-pump 31 supplies working oil to the immersed portion of the piston rod 24*b*.

FIG. 9 is a schematic plan view illustrating the pressed steel plate 46 according to the pressing stages S1 to S4. In stage S1, the progressive pressing apparatus 11 forms, for example, holes 47*a* on the steel plate 46, which are to be arranged around the inner portion of a rotor. In stage S2, the apparatus 11 punches out a segment of the steel plate 46 including the holes 47*a* so as to fabricate a product 47. The product 47 is one of the layers included in a rotor, and the periphery of the product 47 defines the outer dimension of the rotor. In stage S3, the apparatus 11 forms, for example, slots 48*a* on the steel plate 46, which are to be arranged around the inner portion of a stator. In stage S4, the apparatus 11 punches out a segment of the steel plate 46 including the slots 48*a* so as to fabricate a product 48. The product 48 is one of the layers included in a stator, and the periphery of the product 48 defines the outer dimension of the stator. Accordingly, for every cycle of the pressing operation, the apparatus 11 fabricates one layer of a rotor, i.e. the product 47, at the stage S2 and one layer of a stator, i.e. the product 48, at the stage S4.

The replacement of the die assembly 13 and the readjustment of the securing positions of the supporting frames 25 will now be described. Such replacement and readjustment are performed when the fabricating products 47 and 48 are to have different punch-out diameters. In such cases, the die assembly 13 is fixed to the base components 15 such that the die sets 20*a* to 20*d* are positioned at a predetermined pitch. Specifically, the die sets 20*a* to 20*d* are positioned at a pitch that reduces unused areas (unpunched areas) of the steel plate 46. Moreover, the position of each supporting frame 25 is readjusted based on the secured position of the corresponding one of the die sets 20*a* to 20*d*.

When replacing the die assembly 13 with another type, the servomotors 33 are driven so that the hydraulic cylinders 24 are lifted upward. The connection heads 30 are thus disconnected from the punches 29*a* so that the connection heads 30 do not interfere with the die assembly 13 when the die assembly 13 is being moved. The bolts 19*a* and 19*b* are loosened so that the common plate 19 is released from the base components 15. The common plate 19 becomes movable while still being supported by the free bearings 18. The die assembly 13 is then moved in the longitudinal direction of the base components 15 so as to be disassembled from the apparatus 11. Subsequently, a different type of die assembly 13 for fabricating products 47 and 48 having different punch-out diameters is placed above the base components 15 and is moved to a predetermined position. The new die assembly 13 is then fixed to the base components 15 with the bolts 19*a* and 19*b*.

Subsequently, each of the supporting frames 25 is readjusted to a corresponding securing position. First, the corresponding bolts 41 are loosened. As the bolts 41 are loosened, the supporting frame 25 moves downward by its own weight so that the engagement between the stoppers 38 and the dovetail grooves 17 is released. Moreover, the corresponding rolling wheels 36 become in contact with the rails 23. In this state, the supporting frame 25 is shifted to a position corresponding to one of the die sets 20*a* to 20*d* of the die assembly 13. When the supporting frame 25 is shifted to the predetermined position, the bolts 41 are rotated such that the supporting columns 25*a* are lifted upward. Consequently, the stoppers 38 of the corresponding supporting columns 25*a* are pressed against the undersurfaces of the dovetail grooves 17. As a result, each set of the stoppers 38 and the bolts 41 of the supporting columns 25*a* clamps the corresponding base component 15 so that the corresponding supporting frame 25 is tightly secured to the base components 15.

The progressive pressing apparatus 11 according to the embodiment of the present invention has the following advantages.

1. In the progressive pressing apparatus 11, the die sets 20*a* to 20*d* of the die assembly 13 are fixed to the respective pressing stages S1 to S4 in a detachable and readjustable manner. Moreover, the apparatus 11 is provided with the supporting frames 25 each including an actuator (hydraulic cylinder 24) which is capable of extending in the vertical direction and applies a pressing force to one of the die sets 20*a* to 20*d* of the die assembly 13 in the corresponding pressing stages S1 to S4. Each supporting frame 25 is movable along the rails 23 disposed above the pressing stages S1 to S4, and is provided with the securing units 37 for securing the supporting frame 25 to a desired position. Accordingly, each pressing-force applying means (the hydraulic cylinder 24, the supporting frame 25, and the servo-pump 31) can be moved easily and stably in the feeding direction of the workpiece (belt-like steel plate 46), and moreover, can be easily secured to a desired position. Consequently, using only a single progressive pressing apparatus 11 for fabricating products having different punch-out diameters which are to be used as one of the layers of a rotor or a stator, the unused areas (unpunched areas) of the workpiece can be reduced.

2. The supporting frames 25 have a gate-like structure, and the two upper end portions of each supporting frame 25 are provided with the rolling wheels 36. The rolling wheels 36 are capable of rolling along the upper surfaces of the rails 23. Moreover, each supporting frame 25 is provided with a set of securing units 37 for securing the supporting frame 25 to the base components 15 in a state where the rolling wheels 36 are lifted upward and are not in contact with the rails 23. Accordingly, since the rolling wheels 36 are capable of rolling along the rails 23, each supporting frame 25 can be moved with a smaller amount of force in comparison with a case where the rolling wheels 36 are not provided. Furthermore, in comparison with a case where the rolling wheels 36 are disposed in the bottom portions of the supporting columns 25*a*, each supporting frame 25 can be moved stably with a smaller amount of force. Furthermore, the rolling wheels 36 are prevented from receiving unnecessary force when the supporting frames 25 are secured to the base components 15.

3. Each of the securing units 37 is disposed adjacent to the bottom portion of one of the supporting columns 25*a* of each supporting frame 25. Each securing unit 37 includes the stopper 38, which is movable along the dovetail groove 17 of the corresponding base component 15; and the pressing means disposed adjacent to the bottom portion of the corresponding supporting column 25*a*. The pressing means presses against the corresponding base component 15 so that the supporting column 25*a* is relatively pressed upward. Thus, when the pressing means is disposed at the tightened position, the pressing means and the stopper 38 clamp to the base component 15. On the other hand, when the pressing means is disposed at the untightened position, the pressing force of the pressing means against the base component 15 is released. Accordingly, the supporting columns 25*a* can be tightly secured to the base components 15 with a simple structure.

4. Each pressing means includes the bolt 41 extending vertically through the bracket 40, which protrudes outward from the corresponding supporting column 25*a*. Accordingly, in comparison with conventional pressing means including, for example, a lever, the structure of the pressing means according to the embodiment of the present invention is simpler and more compact. Furthermore, since the bolt 41 is screwed into the nut 42, the bolt 41 is prevented from loosening so as to maintain the secured state of the corresponding supporting column 25*a*.

5. The upper side of each supporting frame 25 is provided with the servo-pump 31 for supplying working oil to the corresponding hydraulic cylinder 24. As described above with reference to FIG. 2, the maximum width occupied by each servo-pump 31 is greater than the width of the supporting block 25*b* of the corresponding supporting frame 25. Moreover, the servo-pumps 31 on the adjacent supporting frames 25 are arranged in manner such that the servo-pumps 31 do not interfere with one another. Accordingly, the adjacent supporting frames 25 may be in contact with one another, and therefore, pressing operation for rotors and other products having smaller diameters is possible.

6. The guide rollers 43*a* and 43*b* are provided in one of the upper portions of each supporting frame 25 and are disposed at positions where they can contact the side surfaces of the corresponding rail 23. Accordingly, each supporting frame 25 is prevented from deviating when the supporting frame 25 is being shifted along the rails 23. The shifting of the supporting frames 25 can thus be easily and stably performed.

7. The die assembly 13 is provided with the die sets 20*a* to 20*d* corresponding to the respective pressing stages S1 to S4. The die sets 20*a* to 20*d* are arranged above the common plate 19 at a predetermined pitch and are detachable. Accordingly, for replacing the die assembly 13 with another type so as to switch to a fabrication process of products for rotors and stators having different punch-out diameters, the entire common plate 19 may be replaced with a new one so that new die sets 20*a* to 20*d* can be easily set at their predetermined positions. Furthermore, if a problem occurs in one of the die sets 20*a* to 20*d*, the defective die set may simply be replaced with a new one.

8. For the replacement of the die assembly 13, each of the connection heads 30 must be moved to a position where the connection head 30 does not interfere with the die assembly 13. According to the embodiment of the present invention, in order to achieve this, each of the hydraulic cylinders 24 is set at different positions during the replacement of the die assembly 13 and the pressing operation. When the hydraulic cylinder 24 is set at a position for the pressing operation, the corresponding piston rod 24*b* of the hydraulic cylinder 24 is capable of reciprocating at short strokes. Accordingly, in comparison with having long-stroke type hydraulic cylinders that lift the connection heads fixed to the piston rods to a position where the connection heads do not interfere with the replacement of the die assembly for every stroke of the pressing operation, the piston rods 24*b* according to the embodiment of the present invention are capable of reciprocating at higher speed, thus improving the productivity of the pressing operation.

The technical scope of the present invention is not limited to the above embodiments, and modifications are permissible within the scope and spirit of the present invention. For example, instead of shifting each of the supporting frames 25 manually along the rails 23, a driving device may alternatively be provided for moving the supporting frames 25. In this case, a motor may drive the rolling wheels 36 corresponding to the supporting frame 25 to be driven. Such an alternative structure may provide easier shifting of the supporting frames 25. However, since it is only necessary to move the supporting frames 25 during the replacement of the die assembly 13, moving the supporting frames 25 manually is not a significant problem.

Furthermore, a lever may be used as the pressing means in place of the bolt 41. Such a lever may be included in each of the securing units 37 for securing the supporting frames 25 to the base components 15 in a state where the rolling wheels 36 are lifted upward and are not in contact with the rails 23. For example, the central portion of the lever may be rotatably supported by the corresponding bracket 40, and the bracket 40 may be provided with a rotation-restriction portion for restricting the rotation of the lever while one of the ends of the lever is pressed against the upper surface of the corresponding base component 15.

Furthermore, as an alternative to the rolling wheels 36 that roll along the upper surfaces of the rails 23 for moving the supporting frames 25, magnetic force may be applied such that the supporting frames 25 float above the rails 23. For example, the upper surface of each rail 23 may be provided with a magnet so as to function as one of the magnetic poles, and both sides of each supporting frame 25 may be provided with electromagnets facing the magnets on the upper surfaces of the rails 23. For moving each of the supporting frames 25, the electromagnets are excited so as to generate force of repulsion between the electromagnets and the magnets on the rails 23. This allows the supporting frame 25 to float above the rails 23. In comparison with having the rolling wheels 36, this structure allows shifting of the supporting frames 25 with a smaller amount of force.

The structure of each of the dovetail grooves 17 is not limited to the one illustrated in the drawings. For example, the two side surfaces of each dovetail groove 17 in contact with the stoppers 38 may be slanted. In this case, the two side surfaces of each stopper 38 are also slanted.

Furthermore, as alternative means for preventing the supporting frames 25 from deviating when one of the supporting frames 25 is being shifted along the rails 23, magnets may be disposed on the two side surfaces of one of the rails 23, or the rail 23 itself may be formed of a magnet. In such a case, like the guide rollers 43*a* and 43*b*, a pair of magnets having the same magnetic pole as the magnet(s) of the rail 23 is respectively disposed adjacent to the two side surfaces of the rail 23. Consequently, each of the supporting frames 25 can be prevented from deviation in a non-contact manner.

Furthermore, the deviation-preventing means for preventing the supporting frames 25 from deviating from the rails 23 may alternatively be provided at two upper end portions of each supporting frame 25 instead of just one upper end portion.

As described in the above embodiment, each hydraulic cylinder 24 is set at different positions during the replacement of the die assembly 13 and the pressing operation, such that the corresponding connection head 30 is shifted to a position where the connection head 30 does not interfere with the die assembly 13 during the replacement of the die assembly 13. However, the present invention is not limited to such a structure. For example, each hydraulic cylinder 24 may be a long-stroke type. As mentioned previously, in long-stroke type hydraulic cylinders, the connection heads fixed to the piston rods are lifted to a position where the connection heads do not interfere with the replacement of the die assembly for every stroke of the pressing operation.

Furthermore, in the above embodiment, the die sets 20*a* to 20*d* of the die assembly 13 corresponding to the respective pressing stages S1 to S4 are detachably disposed on the common plate 19 at a predetermined pitch. However, the present invention is not limited to such a structure. For example, instead of having the common plate 19, the die sets 20*a* to 20*d* may be directly disposed on the base components 15 in a detachable manner.

Furthermore, the number of pressing stages does not necessarily have to be four. Alternatively, the number of pressing stages may be two or more, depending on the type of product to be made or the segments to be pressed.

Regardless of the type of die assembly 13 used, one of the supporting frames 25 (which will be referred to as the reference supporting frame 25) may be constantly fixed at a predetermined position so that the position may act as a reference position for determining the setting positions of the die assembly 13 and the other supporting frames 25. For example, the base components 15 may be provided with recesses engageable with the ends of the bolts 41 of the reference supporting frame 25. In comparison with adjusting the positions of all supporting frames 25, this structure provides easier positional adjustment, and can thus shorten the operational time.

The use of the progressive pressing apparatus 11 is not limited to manufacture of rotors and stators. For example, the progressive pressing apparatus 11 may be used for manufacturing other products, such as speaker frames, by inserting belt-like boards or sheets into the apparatus 11 and moving them intermittently through multiple pressing stages such that pressing is performed at each stage.

The power source (actuator) for supplying pressing force to the die assembly 13 does not necessarily have to be the hydraulic cylinders 24. For example, in place of a hydraulic pressing unit provided with the hydraulic cylinder 24, an alternative pressing unit, such as a mechanical pressing unit, having other types of power sources (actuators) may be used.

It is apparent from the above embodiments that one of the supporting frames 25 is constantly fixed at a predetermined position regardless of the type of die assembly 13 used.

What is claimed is:

1. A progressive pressing apparatus comprising:

a die assembly including a plurality of die sets detachably disposed on corresponding pressing stages such that respective positions of the die sets are adjustable;

rails disposed above the pressing stages;

supporting frames, each corresponding to one of the pressing stages, each supporting frame comprising an actuator for applying a pressing force to the corresponding one of the die sets in the pressing stages, said each supporting frame being movable along the rails; and a securing means, for securing the supporting frames to a desired position, further comprising a base, wherein said each supporting frame has a gate-like structure, two opposite upper end portions of said each supporting frame being provided with rolling wheels which are capable of rolling along upper surfaces of the rails, and wherein the securing means secures a corresponding supporting frame to the base in a state such that the rolling wheels of the corresponding supporting frame are not in contact with the rails.

2. The progressive pressing apparatus according to claim 1, wherein said each supporting frame comprises a pair of supporting columns, each pair of the securing means respectively corresponding to the pair of supporting columns of each supporting frame, wherein the base is provided with dovetail grooves, wherein each securing means includes a stopper fixed to a bottom end of the corresponding supporting column, the stopper being movable along a corresponding one of the dovetail grooves; and pressing means for pressing against the base, the pressing means being disposed adjacent to a bottom portion of a corresponding one of the supporting columns, the pressing means being movable between a tightened position and an untightened position, wherein, when the pressing means is set at the tightened position, the pressing means presses against the base such that the corresponding supporting column is relatively pressed upward, whereby the corresponding supporting column is clamped between the pressing means and the stopper, and wherein, when the pressing means is set at the untightened position, the pressing force of the pressing means against the base is released.

3. The progressive pressing apparatus according to claim 2, wherein each pressing means comprises a bolt which extends vertically through a bracket protruding outward from the corresponding supporting column such that the bolt is screwed into the bracket.

4. The progressive pressing apparatus according to claim 3, wherein each actuator comprises a hydraulic cylinder, and wherein an upper surface of each supporting frame is provided with a servo-pump for supplying working oil to the corresponding hydraulic cylinder, the maximum width of each servo-pump being greater than the width of the corresponding supporting frame, the servo-pumps being arranged such that a servo-pump on one supporting frame does not interfere with another servo-pump on an adjacent supporting frame.

5. The progressive pressing apparatus according to claim 2, wherein each actuator comprises a hydraulic cylinder, and wherein an upper surface of each supporting frame is provided with a servo-pump for supplying working oil to the corresponding hydraulic cylinder, the maximum width of each servo-pump being greater than the width of the corresponding supporting frame, the servo-pumps being arranged such that a servo-pump on one supporting frame does not interfere with another servo-pump on an adjacent supporting frame.

6. The progressive pressing apparatus according to claim 1, wherein each actuator comprises a hydraulic cylinder, and wherein an upper surface of each supporting frame is provided with a servo-pump for supplying working oil to the corresponding hydraulic cylinder, the maximum width of each servo-pump being greater than the width of the corresponding supporting frame, the servo-pumps being arranged such that a servo-pump on one supporting frame does not interfere with another servo-pump on an adjacent supporting frame.

7. A progressive pressing apparatus comprising:

a die assembly including a plurality of die sets detachably disposed on corresponding pressing stages such that respective positions of the die sets are adjustable;

rails disposed above the pressing stages;

supporting frames, each corresponding to one of the pressing stages, each supporting frame comprising an actuator for applying a pressing force to the corresponding one of the die sets in the pressing stages, said each supporting frame being movable along the rails; and a securing means, for securing the supporting frames to a desired position, wherein each actuator comprises a hydraulic cylinder, and wherein an upper surface of each supporting frame is provided with a servo-pump for supplying working oil to the corresponding hydraulic cylinder, the maximum width of each servo-pump being greater than the width of the corresponding supporting frame, the servo-pumps being arranged such that a servo-pump on one supporting frame does not interfere with another servo-pump on an adjacent supporting frame.

* * * * *